US008772655B2

(12) United States Patent
Lee

(10) Patent No.: US 8,772,655 B2
(45) Date of Patent: Jul. 8, 2014

(54) RECEPTACLE STRUCTURE AND POWER ADAPTER WITH THE SAME

(75) Inventor: Po-Sheng Lee, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 84 days.

(21) Appl. No.: 13/592,551

(22) Filed: Aug. 23, 2012

(65) Prior Publication Data

US 2014/0057471 A1 Feb. 27, 2014

(51) Int. Cl.
*H01R 33/96* (2006.01)

(52) U.S. Cl.
USPC ..... 200/51.09

(58) Field of Classification Search
USPC ..... 200/6 R, 16, 50.01, 50.29, 51 R, 537, 200/553, 293, 339, 345, 297, 253.1, 200/DIG. 24, 51.09
See application file for complete search history.

(56) References Cited

U.S. PATENT DOCUMENTS 3,944,316 A * 3/1976 Newman et al. ..... 439/181
4,652,067 A * 3/1987 Lutzenberger ..... 439/43
8,496,491 B2 * 7/2013 Baek et al. ..... 439/188

* cited by examiner

*Primary Examiner* — Edwin A. Leon
*Assistant Examiner* — Anthony R. Jimenez
(74) *Attorney, Agent, or Firm* — Chun-Ming Shih; HDLS IPR Services

(57) ABSTRACT

The receptacle includes an insulated body, a pair of pins and a micro switch. The insulated body has a recess. The pair of pins is fixed in the insulated body and located in the recess. The pair of pins includes a first pin and a second pin. The second pin electrically connects a wire. Each of the first and second pins has a free end. The recess is divided into an inner region and an outer region by the two free ends. The micro switch is movably connected in the insulated body and disposed correspondingly to the wire. The micro switch has a contact sheet which can selectively be in contact with the wire. The micro switch is located in the inner region of the recess.

6 Claims, 3 Drawing Sheets

RECEPTACLE STRUCTURE AND POWER ADAPTER WITH THE SAME

BACKGROUND OF THE INVENTION

1. Technical Field

The invention relates to receptacles, particularly to receptacles which can resist electric arcs.

2. Related Art

The AC adapter is a type of external power supply, often enclosed in a case similar to an AC plug. AC adapters are used with electrical devices that require power but do not contain internal components to derive the required voltage and power from mains power. The internal circuitry of an external power supply is very similar to the design that would be used for a built-in or internal supply.

External power supplies are used both with equipment with no other source of power and with battery-powered equipment, where the supply, when plugged in, can sometimes charge the battery in addition to powering the equipment.

Use of an external power supply allows portability of battery-powered equipment without the added bulk of internal power components and makes it unnecessary to produce equipment for use only with a specified power source. An adapter usually has an 8-shaped receptacle for connecting a power cord. However, due to improper uses of users, continuous electric arcs easily occur at the contacts in the receptacle. This may cause pins in the receptacle to be hot enough to make the plastic body melt. Thus, resisting arcs is an important issue for adapters.

SUMMARY OF THE INVENTION

An object of the invention is to provide a receptacle structure and a power adapter with the same, which can resist electric arcs and prevent plastic parts from melting.

To achieve the above object, the power adapter of the invention includes a housing and a receptacle structure. The receptacle includes an insulated body, a pair of pins and a micro switch. The insulated body has a recess. The pair of pins is fixed in the insulated body and located in the recess. The pair of pins includes a first pin and a second pin. The second pin electrically connects a wire. Each of the first and second pins has a free end. The recess is divided into an inner region and an outer region by the two free ends. The micro switch is movably connected in the insulated body and disposed correspondingly to the wire. The micro switch has a contact sheet which can selectively be in contact with the wire. The micro switch is located in the inner region of the recess.

When a plug with two pin holes is inserted into the receptacle, the pin holes are first inserted by the pins and then the micro switch will be pushed by the plug to get closed. The micro switch will be open after the plug has been removed from the receptacle. This can resist electric arcs which happen at the moment the plug is approaching the pins.

DETAILED DESCRIPTION OF THE INVENTION

Figure 1:
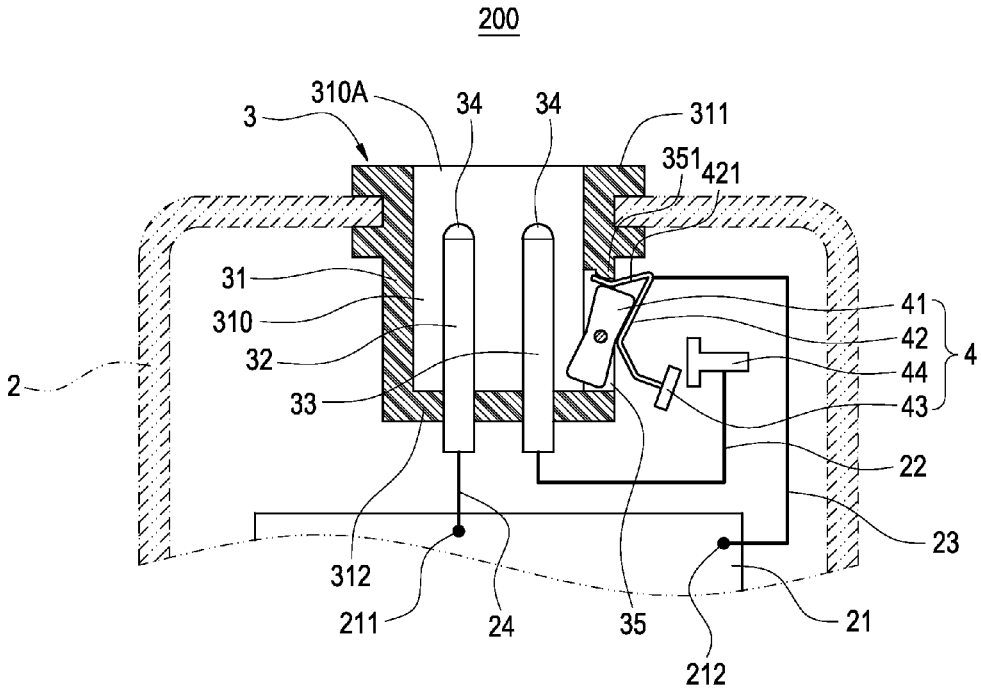
FIG. 1 is a schematic view of the power adapter of the invention.
Figure 2:
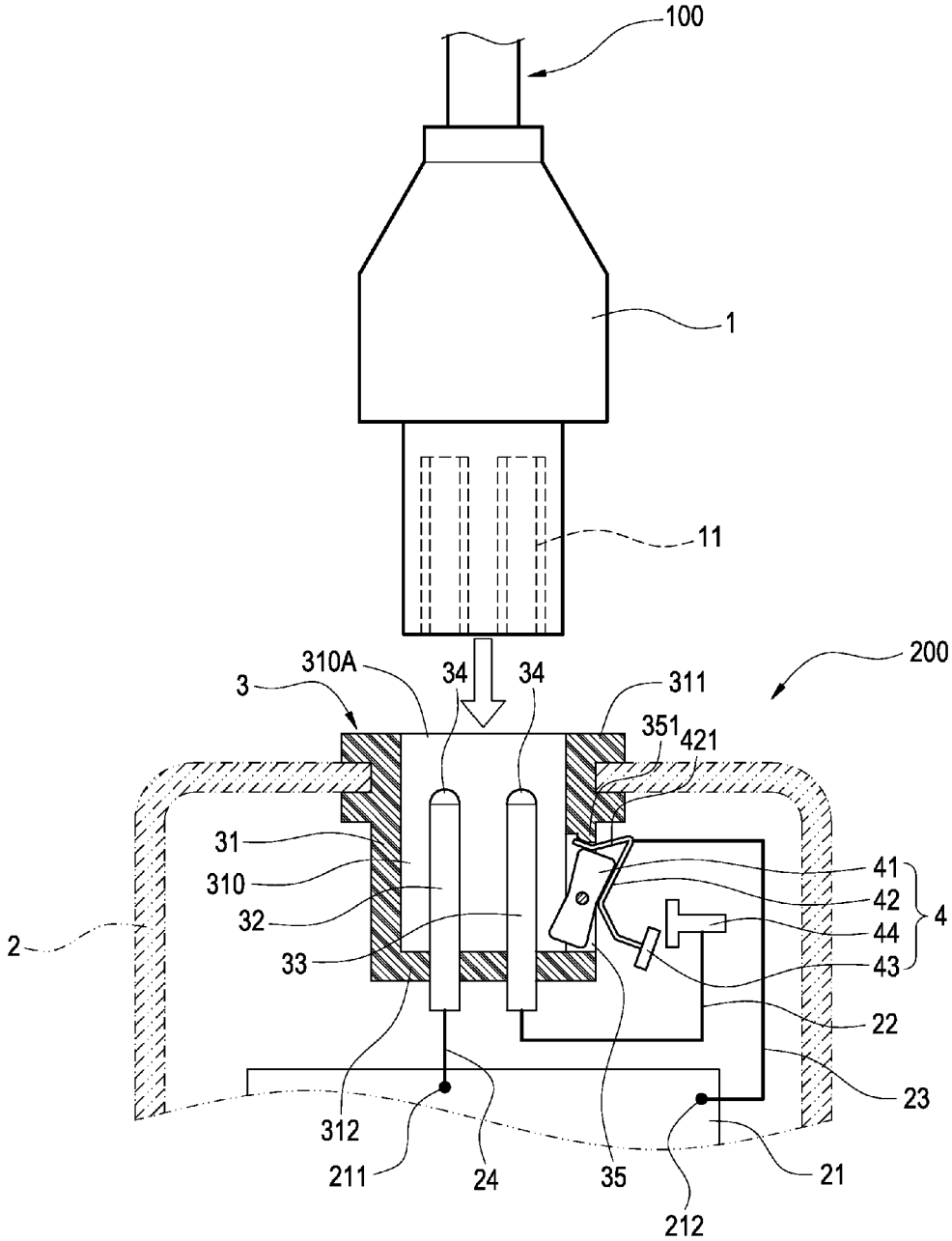
FIG. 2 is a schematic view showing a plug is being inserted into the power adapter of the invention.
Figure 3:
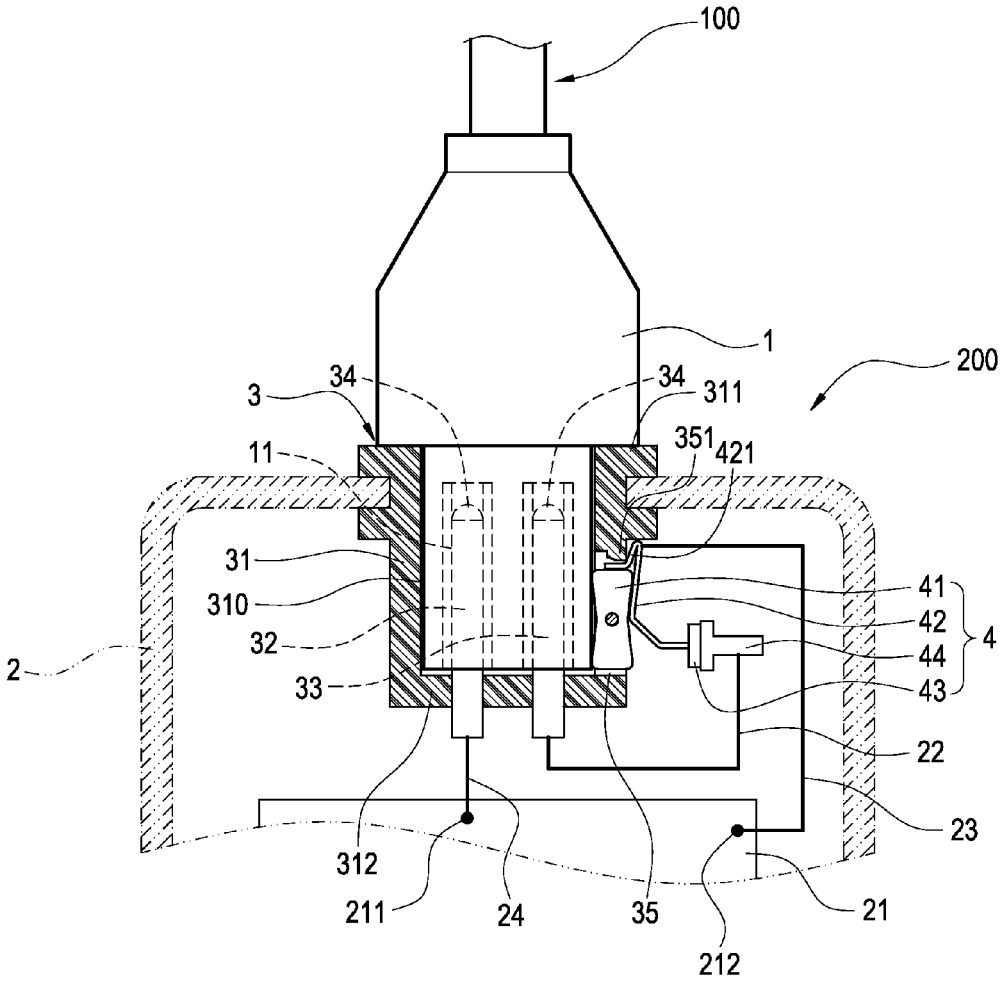
FIG. 3 is a schematic view showing a plug has been inserted into the power adapter of the invention.

FIG. 1 shows the power adapter 200 of the invention and FIGS. 2 and 3 show the power adapter 200 and a power cord 100. As shown in FIG. 2, the power adapter 200 is provided with a receptacle structure 3. The power cord 100 has a plug 1 which can be inserted into the receptacle structure 3. The plug 1 has a pair of pin holes 11.

Please refer to FIGS. 1 and 2. The receptacle structure 3 includes an insulated body 31, a pair of pins 32, 33 and a micro switch 4. The insulated body 31 is composed of side walls 311 and a bottom 312 and is formed with a recess 310 for receiving the plug 1. One of those side walls 311 is further formed with an aperture 35.

The pair of pins includes a first pin 32 and a second pin 33. The two pins 32, 33 are spaced out and fixed in the insulated body 31. The pins 32, 33 are implanted in the bottom 312 and located in the recess 310. The first pin 32 and the second pin 33 are electrically connected to a positive electrode 211 and a first wire 22, respectively. And the first wire 22 is electrically connected to a negative electrode 212 through the micro switch 4. Each of the pins 32, 33 has a free end 34 to serve as a tip. The recess 310 is divided into an inner region and an outer region by the free ends 34. As shown, the opening 310A of the recess 310 is located in the outer region.

The micro switch 4 is moveably connected in the insulated body 31 (i.e., the micro switch 4 can be swayed or rotated in the insulated body 31) and located in the inner region of the recess 310. The micro switch 4 has a contact sheet 42 which correlates to the first wire 22. The contact sheet 42 can be swayed or rotated to make a contact or break with the first wire 22. In other words, the micro switch 4 can turn power on or off.

The micro switch 4 has a rotator 41 rotatably disposed in the insulated body 31, a fixed contact 44 disposed at an end of the first wire 22 and a movable contact 43 on an end of the contact sheet 42. The contact sheet 42 is fastened to the rotator 41 so that the contact sheet 42 can move with the rotator 41 to make the movable contact 43 touch or leave the fixed contact 44. The contact sheet 42 is electrically connected to the negative electrode 212 through a second wire 23. When the movable contact 43 is pushed to touch the fixed contact 44, negative power will be delivered to the second pin 33 through the first and second wires 22, 23 and the contact sheet 42. Positive power is delivered to the first pin 32 through a third wire 24 and the positive electrode 211. The rotator 41 is rotatably connected in the aperture 35 in the inner region of the recess 310. The plug 1 does not touch the rotator 41 until it has been completely or almost completely inserted into the recess 41. In other words, when the pin holes 11 are initially touched by the pins 32, 33 and the rotator 41 is not pushed by the plug 1, the micro switch 4 is open and no power is delivered to the plug 1. Power will be delivered to the plug 1 only after the rotator 41 has been pushed by the plug 1 so as to resist electric arcs.

In detail, the first and second wires 22, 23 will be in contact with each other when the rotator 41 is pushed to make the movable contact 43 touch the fixed contact 44 so that power can be delivered from the pins 32, 33 to the plug 1 through the closed micro switch 4.

Furthermore, the contact sheet 42 is formed with a resilience portion 421 and the aperture 35 has a protrusion 351. The resilience portion 421 flexibly abuts against the protrusion 351. When the rotator 41 is not pushed by the plug 1, the resilience portion 421 will expand against the protrusion 351 to make the movable contact 43 leave the fixed contact 44 and to make the micro switch 4 open. When the rotator 41 is pushed by the plug 1, the resilience portion 421 will be compressed between the protrusion 351 and the rotator 41 to make the movable contact 43 touch the fixed contact 44 and to make the micro switch 4 closed. In other words, the micro switch 4 will automatically keep open when the plug 1 is removed from the recess 310 because of the elasticity of the resilience portion 421.

The aperture 35 can also be located in the bottom 312 and still in the inner region of the recess 310. Similarly, the rotator 41 will not be pushed until the plug 1 is completely inserted into the recess 310. In other words, the micro switch 4 can be located in one of the side walls 311 or bottom 312 in the inner region.

Please refer to FIGS. 2 and 3. The power adapter 200 includes a housing 2 and the abovementioned receptacle structure 3. The housing 2 is provided with a circuit board 21 to connect the electrodes 211, 212 and the second and third wires 23, 24. The receptacle structure 3 is located on one side of the housing 2.

In sum, the micro switch 4 is made closed to deliver power from the pins 32, 33 to the plug 1 only when the plug 1 has been completely inserted into the recess 310, and the micro switch 4 always keeps open when the plug 1 is not or has not been completely inserted into the recess 310. Therefore, no power is delivered to the pins 32, 33 and the plug 1 when they have not been in contact with each other so that no electric arc will occur therebetween.

It will be appreciated by persons skilled in the art that the above embodiment has been described by way of example only and not in any limitative sense, and that various alterations and modifications are possible without departure from the scope of the invention as defined by the appended claims.

What is claimed is:

1. A receptacle structure comprising:

an insulated body, having a first sidewall defining a recess, an aperture being formed in the first sidewall and defined by a second sidewall, and a protrusion protruding into the aperture from the second sidewall;

a pair of pins, fixed in the insulated body, and located in the recess, wherein the pair of pins includes a first pin and a second pin, the second pin electrically connects a wire, each of the first and second pins has a free end, and the recess is divided into an inner region and an outer region by the two free ends; and a micro switch, located in the inner region of the recess, movably connected in the insulated body, disposed correspondingly to the wire, wherein the micro switch has a rotator and a contact sheet, the rotator is rotatably disposed in the aperture, abutting against the contact sheet, and the contact sheet includes a resilient portion disposed between the protrusion and the rotator, abutting against the protrusion, wherein the rotator is operable to rotate between a first position and a second position, when the rotator is in the first position, the rotator protrudes into the recess beyond the second sidewall, when the rotator is rotated into the second position, the resilient portion of the contact sheet elastically deforms by a force of the rotation of the rotator, and the contact sheet electrically contacts the wire.

2. The receptacle structure of claim 1, wherein a fixed contact is disposed at an end of the wire and a movable contact is disposed on an end of the contact sheet, and the contact sheet can move by the pushing of the rotator to make the movable contact touch the fixed contact.

3. The receptacle structure of claim 1, wherein the insulated body further has a bottom, the first and second pins are implanted in the bottom, and the micro switch is connected to the sidewall.

4. A power adapter for connecting a plug with pin holes, comprising:

a housing; and a receptacle structure comprising:

an insulated body, fixed in the housing, and having a first sidewall defining a recess for being inserted by the plug, and an aperture being formed in the first sidewall and defined by a second sidewall, and a protrusion protruding into the aperture from the second sidewall;

a pair of pins, fixed in the insulated body, and located in the recess, wherein the pair of pins includes a first pin and a second pin, the second pin electrically connects a wire, each of the first and second pins has a free end, and the recess is divided into an inner region and an outer region by the two free ends; and a micro switch, located in the inner region of the recess, movably connected in the insulated body, disposed correspondingly to the wire, wherein the micro switch has a rotator and a contact sheet, the rotator is rotatably disposed in the aperture, abutting against the contact sheet, and the contact sheet includes a resilient portion disposed between the protrusion and the rotator, abutting against the protrusion, wherein the rotator is operable to rotate between a first position and a second position, when the rotator is in the first position, the rotator protrudes into the recess beyond the second sidewall, when the rotator is rotated into the second position, the resilient portion of the contact sheet elastically deforms by a force of the rotation of the rotator, and the contact sheet electrically contacts the wire, and wherein the micro switch is made closed to deliver power from the pins to the plug only when the plug is inserted into the inner region of the recess and pushes the rotator to the second position, and the micro switch keeps open when the plug is removed from the inner portion of the recess and the rotator is in the first position.

5. The receptacle structure of claim 4, wherein a fixed contact is disposed at an end of the wire and a movable contact is disposed on an end of the contact sheet, and the contact sheet can move by the pushing of the rotator to make the movable contact touch the fixed contact.

6. The receptacle structure of claim 4, wherein the insulated body further has a bottom, the first and second pins are implanted in the bottom, and the micro switch is connected to the at least one side wall.

* * * * *